US009169752B2

(12) United States Patent
Hodgson et al.

(10) Patent No.: US 9,169,752 B2
(45) Date of Patent: Oct. 27, 2015

(54) DEVICE HAVING AN ANNULAR ELECTRODE FOR DECREASING SOOT PARTICLES IN THE EXHAUST GAS OF AN INTERNAL COMBUSTION ENGINE

(71) Applicant: EMITEC GESELLSCHAFT FUER EMISSIONSTECHNOLOGIE, Lohmar (DE)

(72) Inventors: Jan Hodgson, Troisdorf (DE); Christian Vorsmann, Cologne (DE); Rolf Brüeck, Bergisch Gladbach (DE)

(73) Assignee: EMITEC Gesellschaft fuer Emissionstechnologies mbH, Lohmar (DE)

( * ) Notice: Subject to any disclaimer, the term of this patent is extended or adjusted under 35 U.S.C. 154(b) by 290 days.

(21) Appl. No.: 13/783,998

(22) Filed: Mar. 4, 2013

(65) Prior Publication Data

US 2013/0175174 A1 Jul. 11, 2013

Related U.S. Application Data

(63) Continuation of application No. PCT/EP2011/064408, filed on Aug. 22, 2011.

(30) Foreign Application Priority Data

Sep. 3, 2010 (DE) ..... 10 2010 044 343

(51) Int. Cl.
*F01N 3/00* (2006.01)
*B03C 3/41* (2006.01)
(Continued)

(52) U.S. Cl.
CPC ..... *F01N 3/0275* (2013.01); *F01N 13/102* (2013.01); *F01N 2240/04* (2013.01); *F01N 2470/24* (2013.01)

(58) Field of Classification Search
CPC combination set(s) only.
See application file for complete search history.

(56) References Cited

U.S. PATENT DOCUMENTS 3,157,479 A * 11/1964 Boles ..... 96/82
3,740,925 A * 6/1973 Gothard ..... 95/74
(Continued)

FOREIGN PATENT DOCUMENTS

DE 102005013183 A1 10/2005
EP 1 674 160 A1 6/2006
(Continued)

OTHER PUBLICATIONS

International Search Report of PCT/EP2011/064408, (ISR—mail date Dec. 21, 2011; completion date Dec. 13, 2011).

*Primary Examiner* — Duane Smith
*Assistant Examiner* — Sonji Turner
(74) *Attorney, Agent, or Firm* — Laurence A. Greenberg; Werner H. Stemer; Ralph E. Locher

(57) ABSTRACT

A device for decreasing soot particles in exhaust gas, especially from an internal combustion engine, includes concentric outer and inner tubes forming an intermediate space through which the exhaust gas can flow. At least one annular electrode with a multiplicity of electrode tips protruding radially into the intermediate space is disposed on the inside of the outer tube. Terminals can connect the annular electrode and inner tube to a high voltage source forming an electric field in the intermediate space. At least two electrodes are preferably disposed axially at an electrode spacing of preferably 10 to 30 mm. The electrode tips can be approximately conical or pin-shaped with a radial length of 3 to 10 mm. The electrode tips of each electrode have a tip spacing in circumferential direction of 3 to 20 mm or 5 to 10 mm creating a very effective and uniform radial electric field for ionization.

15 Claims, 2 Drawing Sheets

(51) Int. Cl.
*F01N 3/027* (2006.01)
*F01N 13/10* (2010.01)

(56) References Cited

U.S. PATENT DOCUMENTS

| | | | | | |
|---|---|---|---|---|---|
| 4,376,637 | A | * | 3/1983 | Yang | 95/74 |
| 4,478,613 | A | * | 10/1984 | Brettschneider et al. | 96/61 |
| 5,003,774 | A | * | 4/1991 | Leonard | 96/52 |
| 5,041,145 | A | * | 8/1991 | Kakinuma et al. | 96/52 |
| 5,521,383 | A | * | 5/1996 | Furukawa et al. | 250/324 |
| 5,953,909 | A | * | 9/1999 | Waltrip, III | 60/275 |
| 6,482,253 | B1 | * | 11/2002 | Dunn | 96/62 |
| 7,758,675 | B2 | * | 7/2010 | Naito et al. | 96/61 |
| 2003/0098230 | A1 | | 5/2003 | Carlow et al. | |
| 2005/0223893 | A1 | | 10/2005 | Hoverson et al. | |
| 2007/0245898 | A1 | * | 10/2007 | Naito et al. | 96/65 |
| 2008/0066621 | A1 | * | 3/2008 | Naito et al. | 96/55 |

FOREIGN PATENT DOCUMENTS

| | | | | | |
|---|---|---|---|---|---|
| EP | 1 757 368 | A1 | | 2/2007 | |
| FR | 2843611 | A1 | * | 2/2004 | F01N 3/01 |
| WO | 9730274 | A1 | | 8/1997 | |

* cited by examiner

DEVICE HAVING AN ANNULAR ELECTRODE FOR DECREASING SOOT PARTICLES IN THE EXHAUST GAS OF AN INTERNAL COMBUSTION ENGINE

CROSS-REFERENCE TO RELATED APPLICATION

This application is a continuation, under 35 U.S.C. §120, of copending International Application No. PCT/EP2011/064408, filed Aug. 22, 2011, which designated the United States; this application also claims the priority, under 35 U.S.C. §119, of German Patent Application DE 10 2010 044 343.3, filed Sep. 3, 2010; the prior applications are herewith incorporated by reference in their entirety.

BACKGROUND OF THE INVENTION

Field of the Invention

The subject matter of the present invention relates to a device for decreasing soot particles in the exhaust gas of an internal combustion engine.

Internal combustion engines that are driven by using hydrocarbons as fuel emit an exhaust gas that contains inter alia particles that contain carbon. Those particles that contain carbon or particles of ash that also occur in the exhaust gas have different sizes and their distribution depends on many conditions. In particular, particles that have small diameters and are also described as fine dust are supposedly responsible for illnesses in humans and animals. The term "fine dust" is understood herein to mean, in particular, particles having an average diameter which is 100 nanometers or less. Particles that contain carbon also include, in particular, carbon particles that possibly contain accumulated hydrocarbons.

In order to decrease the particle emissions, in particular in motor vehicles, so-called closed particle filters are often used, wherein exhaust gas flows through a structure that includes alternately closed channels and porous walls between the channels. In order to guarantee the lowest possible counter pressure in the particle filter even in the already charged state, porosities must be used that, in particular, allow the fine dust to pass through fundamentally still unfiltered.

It is also known, that by providing an electric field and/or a plasma, an agglomeration of small soot particles and/or ash particles are formed into larger particles and/or electrically charged particles are formed. Electrically charged particles and/or larger particles are considerably easier to be separated out at regular intervals in a filter system. Agglomerates of soot particles are transported in an exhaust gas flow in a more inert manner due to their greater mass inertia and thus deposit themselves at sites where the exhaust gas flow is deflected. Due to their charge, electrically charged soot particles are drawn towards oppositely-charged surfaces on which they collect and emit their charge. That also facilitates the removal of soot particles from the exhaust gas flow when operating motor vehicles with different filtering or separating devices.

The efficacy of an electric field for the described processes depends inter alia on the field strength, the homogeneity of the electric field in the effective range and its reproducibility over long periods of time. Differentiation is made between devices having axial electric fields that are disposed, for example, in the flow direction of an exhaust gas and devices having radial electric fields that are disposed in a transverse manner with respect to the flow direction. In the latter case, it is particularly difficult to achieve a homogeneous field distribution that captures the exhaust gas flow as completely as possible.

SUMMARY OF THE INVENTION

It is accordingly an object of the invention to provide a device having an annular electrode for decreasing soot particles in the exhaust gas of an internal combustion engine, which overcomes the hereinafore-mentioned disadvantages and at least partially solves the highlighted problems of the heretofore-known devices of this general type and which, in particular, is improved with respect to the prior art for generating an electric field for a mobile exhaust gas treatment system.

With the foregoing and other objects in view there is provided, in accordance with the invention, a device for decreasing or reducing soot particles in an exhaust gas, in particular in an exhaust gas of an internal combustion engine. The device comprises an outer tube and an inner tube disposed in a concentric manner with respect thereto, the tubes forming an intermediate space through which the exhaust gas can flow. At least one annular electrode having a multiplicity of electrode tips that protrude radially into the intermediate space is disposed on the outer tube and terminals for connecting the annular electrode and the inner tube to a high voltage source are provided for generating a radial electric field in the intermediate space. The configuration of multiple electrode tips that are positioned facing inwards from the outside renders it possible to provide a particular uniform ionization in the intermediate space between the outer tube and the inner tube. Small deformations of the outer tube and other deviations from an optimum geometric shape only have a small influence on point discharges at the electrode tips, so that a relatively homogeneous field prevails in the intermediate space and there is a high probability of exhaust gas components being ionized in the intermediate space.

The term "annular" is intended, in particular, to mean that the axial dimension of the electrode in the axial direction is smaller than the dimension in the radial direction. Thus, the annular electrode preferably includes a length in the axial direction of a maximum of 20 cm [centimeters], particularly preferably a maximum of 10 cm or even a maximum of 6 cm.

Depending upon the choice of reference potential, it may be necessary to separate annular electrodes from the outer tube through the use of an electric insulator, which corresponds to a preferred embodiment of the invention.

Alternatively, the annular electrode is located in another exemplary embodiment with the outer tube at ground potential, wherein the inner tube must then be disposed in the outer tube in an electrically insulated manner in order to be able to apply a high voltage. A positive voltage is applied to the inner tube in this case.

A further option resides in connecting the inner tube and the outer tube to ground potential and electrically insulating the annular electrode from both.

In order to increase the ionizing rate, preferably two or more annular electrodes are disposed axially one behind the other, wherein the respective electrode spacing is preferably 10 to 30 mm in the axial direction. It is possible in this manner to build up an ionizing electric field over a longer partial area of the intermediate space which increases the degree of efficiency during ionization.

The electrode tips can be embodied very differently and also not rotationally symmetrically but they are preferably conical or pin-shaped and include a radial length of 3 to 10 mm. This embodiment only slightly impairs the exhaust gas flow in the intermediate space but it is suitable for uniformly distributing the desired point discharges, which are also known as corona discharges. In particular, conical electrode tips are resistant to deformation and wear.

In accordance with the invention, the electrode tips of each annular electrode have a tip spacing of 3 to 20 mm, preferably 5 to 10 mm, in the circumferential direction. A multiplicity of electrode tips can be accommodated in this manner uniformly around the circumference of an exhaust gas system.

If, in accordance with a further preferred embodiment, several electrodes are disposed in an axial manner one behind the other, then the electrode tips of axially adjacent annular electrodes should not be aligned with each other in the axial direction. On the contrary they are, in particular, to be disposed offset with respect to each other at regular intervals. In the case of an identical number of electrode tips in the annular electrodes, they should be disposed in the circumferential direction offset with respect to each other by half a tip spacing.

Other features which are considered as characteristic for the invention are set forth in the appended claims, noting that the features mentioned individually in the claims can be combined with one another in any technologically expedient manner and can be supplemented by explanatory facts in the description, in which further embodiments of the invention are disclosed.

Although the invention is illustrated and described herein as embodied in a device having an annular electrode for decreasing soot particles in the exhaust gas of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
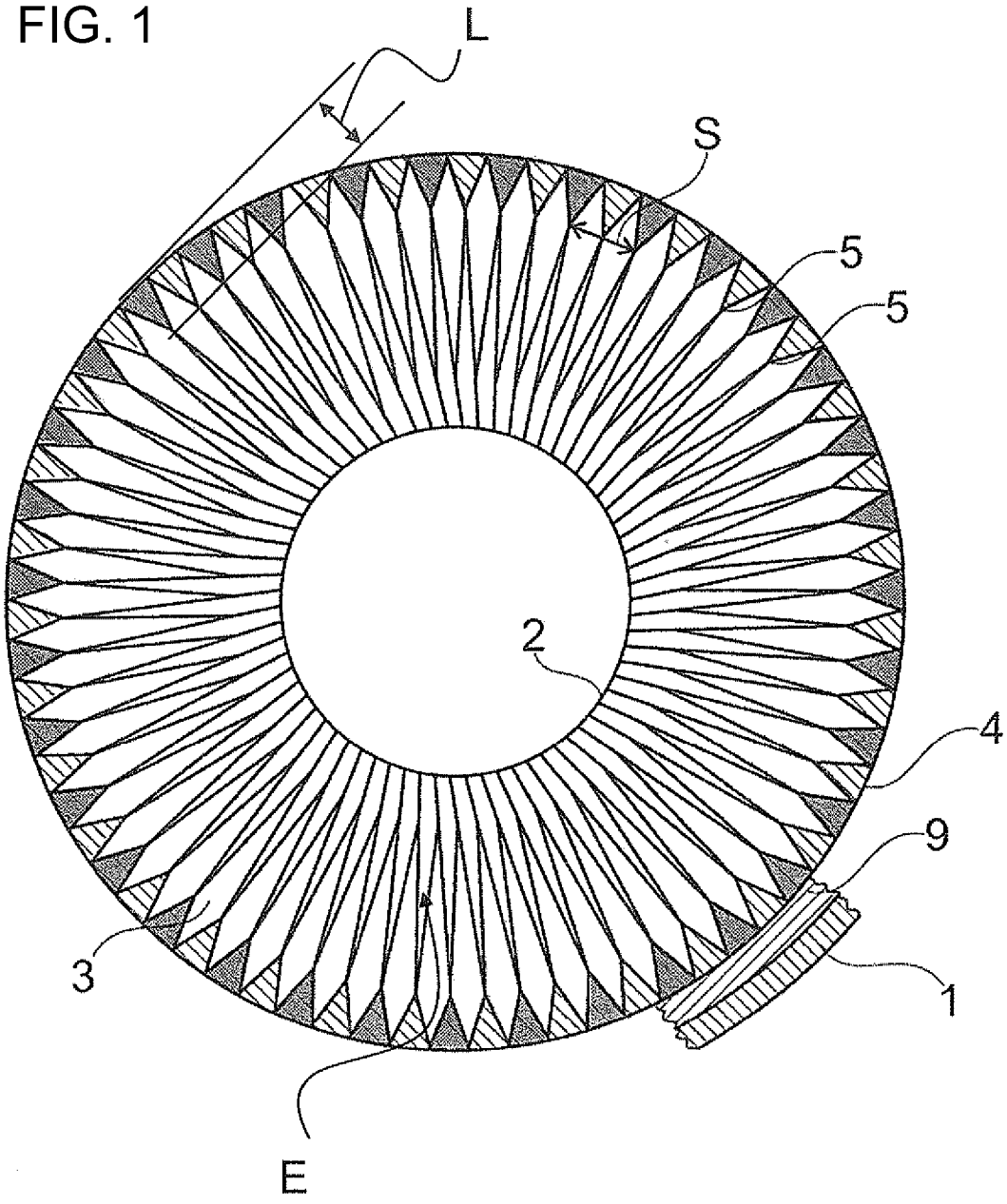
FIG. 1 is a fragmentary, diagrammatic, cross-sectional view of a device according to the invention.

Referring now to the figures of the drawings in detail and first, particularly, to FIG. 1 thereof, there is seen an outer tube 1 and an inner tube 2 which form or define an intermediate space or chamber 3 through which an exhaust gas can flow. An annular electrode 4, that is insulated by an electric insulator 9 on the inside of the outer tube 1, supports a multiplicity of electrode tips 5 that are positioned facing radially inwards. The electrode tips each have a length L and a respective tip spacing S. When applying a high voltage between the inner tube 2 and the annular electrode 4, a radial electric field E is formed in the intermediate space 3 and corona discharges occur at the electrode tips 5 when sufficient initial voltage is applied. Preferred paths of exiting electrons in the direction towards the inner tube 2 are indicated in FIG. 1 by elongated triangles. It is evident that an almost uniform density of electrons is to be expected, in particular close to the inner tube 2. These electrons ionize components of the exhaust gas, in particular soot particles, when they collide and thus facilitate their agglomeration and/or deposition on a downstream filter body that is not illustrated therein. Consequently, the deposition rate in a particle filter is improved.

Figure 2:
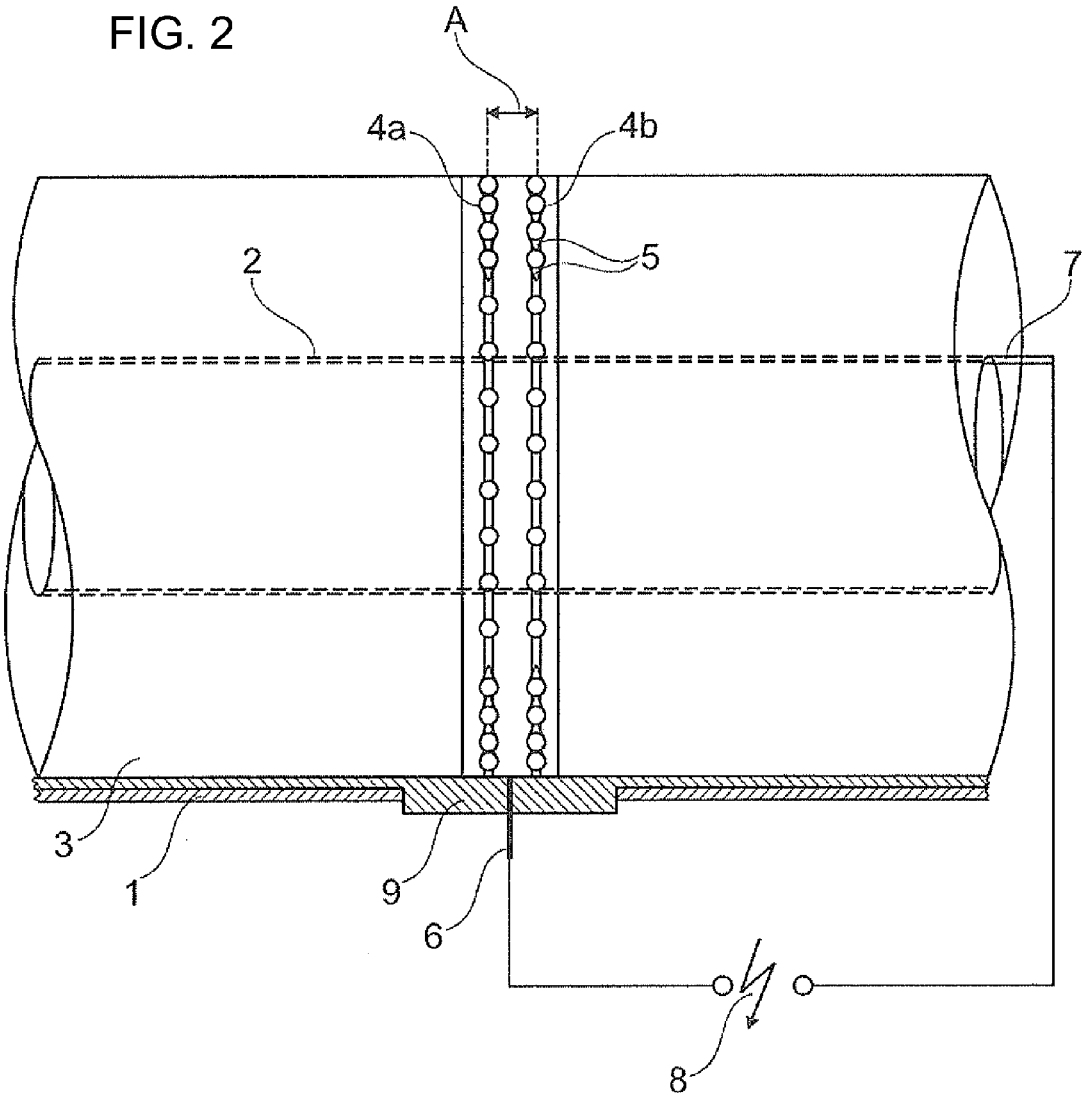
FIG. 2 is a fragmentary, partly-sectional, side-elevational view of the device.

FIG. 2 illustrates a partly-sectional, side-elevational view of the device according to the invention, in this case with two annular electrodes 4*a*, 4*b* that are disposed one behind the other in the axial direction, in which the two annular electrodes are equipped with numerous electrode tips 5. The two annular electrodes define a spacing A therebetween in the axial direction. An electric insulator 9 separates the annular electrodes 4*a*, 4*b* from the outer tube 1. A first terminal 6 is provided for connecting the annular electrodes 4*a*, 4*b* to a high voltage source 8. A second terminal 7, which is illustrated diagrammatically therein, is used to connect the inner tube 2 to the high voltage source 8.

The present invention renders it possible, in conjunction with a particle filter that is connected downstream, to treat an exhaust gas in a uniform manner and in a manner that can be adjusted to suit different operating conditions and is less susceptible to interference when using ionizing high voltages.

The invention claimed is:

1. A device for decreasing soot particles in an exhaust gas, the device comprising:

concentrically disposed outer and inner tubes forming an intermediate space therebetween through which the exhaust gas can flow;

at least two annular electrodes disposed on an inside of said outer tube and having a multiplicity of electrode tips protruding radially into said intermediate space, said at least two annular electrodes being disposed axially one behind the other at a respective electrode spacing of 10 to 30 mm; and terminals configured to connect said at least one annular electrode and said inner tube to a high voltage source to generate an electric field in said intermediate space.

2. The device according to claim 1, wherein said intermediate space is configured to conduct a flow of an exhaust gas of an internal combustion engine.

3. The device according to claim 1, which further comprises an electric insulator separating said at least one annular electrode from said outer tube.

4. The device according to claim 1, wherein said outer tube and said at least one annular electrode are configured to be connected to ground potential, and said inner tube is disposed in said outer tube in an electrically insulated manner.

5. The device according to claim 1, wherein said outer tube and said inner tube are configured to be connected to ground potential.

6. A device for decreasing soot particles in an exhaust gas, the device comprising:

concentrically disposed outer and inner tubes forming an intermediate space therebetween through which the exhaust gas can flow;

at least one annular electrode disposed on an inside of said outer tube and having a multiplicity of electrode tips protruding radially into said intermediate space;

said electrode tips being conical or pin-shaped and having a radial length of 3 to 10 mm; and terminals configured to connect said at least one annular electrode and said inner tube to a high voltage source to generate an electric field in said intermediate space.

7. A device for decreasing soot particles in an exhaust gas, the device comprising:

concentrically disposed outer and inner tubes forming an intermediate space therebetween through which the exhaust gas can flow;

at least one annular electrode disposed on an inside of said outer tube and having a multiplicity of electrode tips protruding radially into said intermediate space;

said electrode tips on each said at least one annular electrode having a tip spacing of 3 to 20 mm in circumferential direction; and terminals configured to connect said at least one annular electrode and said inner tube to a high voltage source to generate an electric field in said intermediate space.

8. The device according to claim 6, wherein said intermediate space is configured to conduct a flow of an exhaust gas of an internal combustion engine.

9. The device according to claim 6, which further comprises an electric insulator separating said at least one annular electrode from said outer tube.

10. The device according to claim 6, wherein said outer tube and said at least one annular electrode are configured to be connected to ground potential, and said inner tube is disposed in said outer tube in an electrically insulated manner.

11. The device according to claim 6, wherein said outer tube and said inner tube are configured to be connected to ground potential.

12. The device according to claim 7, wherein said intermediate space is configured to conduct a flow of an exhaust gas of an internal combustion engine.

13. The device according to claim 7, which further comprises an electric insulator separating said at least one annular electrode from said outer tube.

14. The device according to claim 7, wherein said outer tube and said at least one annular electrode are configured to be connected to ground potential, and said inner tube is disposed in said outer tube in an electrically insulated manner.

15. The device according to claim 7, wherein said outer tube and said inner tube are configured to be connected to ground potential.

* * * * *